US005224507A

United States Patent [19]

Vosse

[11] Patent Number: 5,224,507

[45] Date of Patent: Jul. 6, 1993

[54] PORTABLE PROTECTIVE STRUCTURE WHICH AVOIDS ROOF SAG AND POCKETING

[75] Inventor: Wilfried H. Vosse, Longwood, Fla.

[73] Assignee: Gale Group, Inc., Orlando, Fla.

[21] Appl. No.: 550,392

[22] Filed: Jul. 10, 1990

[51] Int. Cl.[5] ..... E04H 15/36

[52] U.S. Cl. ..... 135/102; 135/104; 135/106; 135/115; 135/907

[58] Field of Search ..... 135/102, 104, 109, 112, 135/115, 907, 900, 101, 106, 97, 87

[56] References Cited

U.S. PATENT DOCUMENTS

| | | | |
|---|---|---|---|
| 1,492,785 | 5/1924 | Frederick | 135/907 X |
| 1,666,757 | 4/1928 | Snyder | 135/112 |
| 1,792,670 | 2/1931 | Wickstrum | 135/104 |
| 1,820,002 | 8/1931 | Forrester | 135/907 X |
| 1,840,745 | 1/1932 | Shoaf | 135/104 X |
| 2,027,984 | 1/1936 | Kapp | 135/106 X |
| 2,130,919 | 9/1938 | Erickson et al. | 135/106 X |
| 2,349,993 | 5/1944 | Schwimmer et al. | 135/97 |
| 2,440,557 | 4/1948 | Power | 135/97 X |
| 2,535,618 | 12/1950 | Williams . | |
| 2,811,164 | 10/1957 | Ames | 135/907 X |
| 2,928,403 | 3/1960 | Hoskins | 135/907 X |
| 3,128,781 | 4/1964 | Kirkham | 135/104 X |
| 3,441,037 | 4/1969 | Transean . | |
| 3,874,396 | 4/1975 | Kirkham . | |
| 3,960,161 | 6/1976 | Norman . | |
| 4,229,914 | 10/1980 | Lucas . | |
| 4,558,713 | 12/1985 | Hagler et al. | 135/109 X |
| 4,641,676 | 2/1987 | Lynch | 135/115 X |
| 4,677,999 | 7/1987 | Cannon et al. . | |
| 4,793,371 | 12/1988 | O'Ferrell et al. . | |
| 4,827,958 | 5/1989 | Cantwell et al. | 135/104 |
| 4,947,884 | 8/1990 | Lynch | 135/97 |

FOREIGN PATENT DOCUMENTS

| | | |
|---|---|---|
| 2339320 | 2/1975 | Fed. Rep. of Germany . |
| 2430531 | 2/1980 | France . |
| 864383 | 12/1986 | South Africa . |
| 277443 | 10/1927 | United Kingdom . |

OTHER PUBLICATIONS

Best Spring '92 Catalog, p. 14.

*Primary Examiner*—Carl D. Friedman
*Assistant Examiner*—Lan M. Mai
*Attorney, Agent, or Firm*—Allen, Dyer, Doppelt, Franjola & Milbrath

[57] ABSTRACT

The structure is adapted for frequent set-up and take-down and is designed to avoid roof sag and pocketing. The structure includes a framework having plural vertical supports and plural horizontal supports bridging between adjacent vertical supports. A removable roof cover is dimensioned to extend over and removably attached to the structural framework, and defines plural corners, with each corner positioned at an intersection of a horizontal support and a vertical support so as to define an intermediate roof field between adjacent corners. The vertical supports include elevated curves for lifting the corners of the roof cover, so as to form the intermediate field in a trough, the peripheral hem of the roof cover being removably attached to the vertical supports to draw the roof cover taut across the intermediate field and thereby avoid roof sag and pocketing.

17 Claims, 2 Drawing Sheets

PORTABLE PROTECTIVE STRUCTURE WHICH AVOIDS ROOF SAG AND POCKETING

BACKGROUND OF THE INVENTION

The present invention relates generally to portable canopies, tents and shade structures.

There are a variety of tent and canopy constructions utilizing a structural framework across which a removable cover is placed, the particular features of the construction being dependent upon the use to which the construction is directed. The roof covers which have been utilized in such structures are generally formed of a material which is intended to completely interdict moisture (i.e., rain and dew), and is therefore generally inflexible. However, when subjected to frequent use, such fabrics are subject to stretching, and therefore frequently form sags or pockets into which water may collect.

Recently, there have been a class of portable shade structures manufactured by the Gale Group, Inc. (formerly Weathashade Corporation) under the trademarks PORTASHADE, GAZEBO and PAVILION. These portable shade structures are characterized by a knockdown structural framework and a roof cover of a stretchable woven shade cloth which is not designed to prevent the flow of water, but is designed to interdict a majority of sunlight. In order to stretch these woven fabric shade cloth covers, the cover typically is hooked at the peripheral hem to one of a number of vertical supports which form a part of the knockdown structural framework.

There are some uses for portable shade structures that dictate a need for a generally inflexible material such as that used in the prior art for tents and canopies, but which avoid roof sag and pocketing. Some of such uses also dictate the need for a portable shade structure which may be taken down and set up frequently without incurring the risk of such sagging and pocketing; for example, such uses include portable display shelters for fleamarkets, outdoor exhibits at weekend art festivals and similar events.

Prior art of interest is disclosed in the following U.S. Pat. Nos. 4,677,999 to Cannon et al; 3,874,396 to Kirkham; 3,960,161 to Norman; 4,229,914 to Lucas; 4,793,371 to O'Ferrell et al; 1,792,670 to Wickstrum; 2,535,618 to Williams and 3,441,037 to Transean. See also, Australian Patent 3297/26; German Patent 23 39 320; French Patent 2,430,531; U.K. Patent 277,443; and South African Patent 86/4383.

SUMMARY OF THE INVENTION

The present invention is directed to a portable protective structure adapted for frequent set-up and take-down and which avoids roof sag and pocketing, but is adaptable for use with a relatively inflexible roof cover of a material which will interdict and shed rain without leaking.

To this end, there is provided a portable structural framework including plural vertical supports, plural horizontal support segments and plural roof supports, each vertical support having a pair of the horizontal support segments pivotably coupled thereto at one end of each horizontal segment adjacent the upper extremity of the corresponding vertical support. The associated pair of horizontal supports are disposed at a predetermined angle, common to all of the vertical supports, each horizontal support segment having an opposing end interfitting with a horizontal support segment associated with an adjacent vertical support. Each of the roof supports extends from a central peak to one of the vertical supports.

The structure further includes a removable roof cover dimensioned to extend over, and be removable attached to the structural framework, the roof cover defining plural corners, with each corner positioned at an intersection of the horizontal support segment and a vertical support, the roof cover further including an intermediate roof field between adjacent corners. The roof cover includes a peripheral hem extending below the bridging horizontal segments and defining an elongated extension of the cover extending along each vertical support, with means for securing the extremity of each of the elongated extensions along the corresponding vertical support to facilitate the stretching of the removable cover taut across the structural framework.

In the preferred form, means are provided for elevating the corners of the roof cover with respect to the intermediate field in order to avoid roof sag and pocketing across each intermediate field; in one example, each roof support and a corresponding vertical support form a smooth curve underneath the adjacent corner of the roof cover, with the curve extending substantially above the level of the adjacent horizontal support segments, so as to elevate the corresponding corner of the roof cover relative to the horizontal support segments, to thereby permit the intermediate field to define a generally concave trough between adjacent roof supports, the bottom of the trough lying across the horizontal support segments.

It is preferred that each roof support is bowed upwardly between the central peak and the intersection with the corresponding vertical support, and that each horizontal support segment is pivotably coupled to one of the vertical supports with a pivot arm coupled to each horizontal segment and the corresponding vertical support. A collar and ring assembly is provided for each vertical support-horizontal support segment combination, with the collar sliding along the vertical support to facilitate the easy set-up or take-down of the portable support structure.

The construction of the structural framework combined with the elevated corners of the roof cover and the means for securing the peripheral hem of the roof cover downwardly along the vertical supports and below the level of the horizontal support segments is particularly useful for roof covers made of materials which are relatively inflexible, and which are designed to completely interdict water while avoiding any roof sag or pocketing. This is achieved in a manner which permits the roof cover to be stretched both downwardly along the vertical support and laterally from the center of the horizontal segments between adjacent vertical supports, while elevating the roof cover corners, to thereby define the concave trough in a secure, taut manner, as will be more fully appreciated from the drawings and detailed description set forth below.

THE DRAWINGS

DETAILED DESCRIPTION

A preferred embodiment of the portable protective structure will now be described with reference to FIGS. 1-3.

Figure 1:
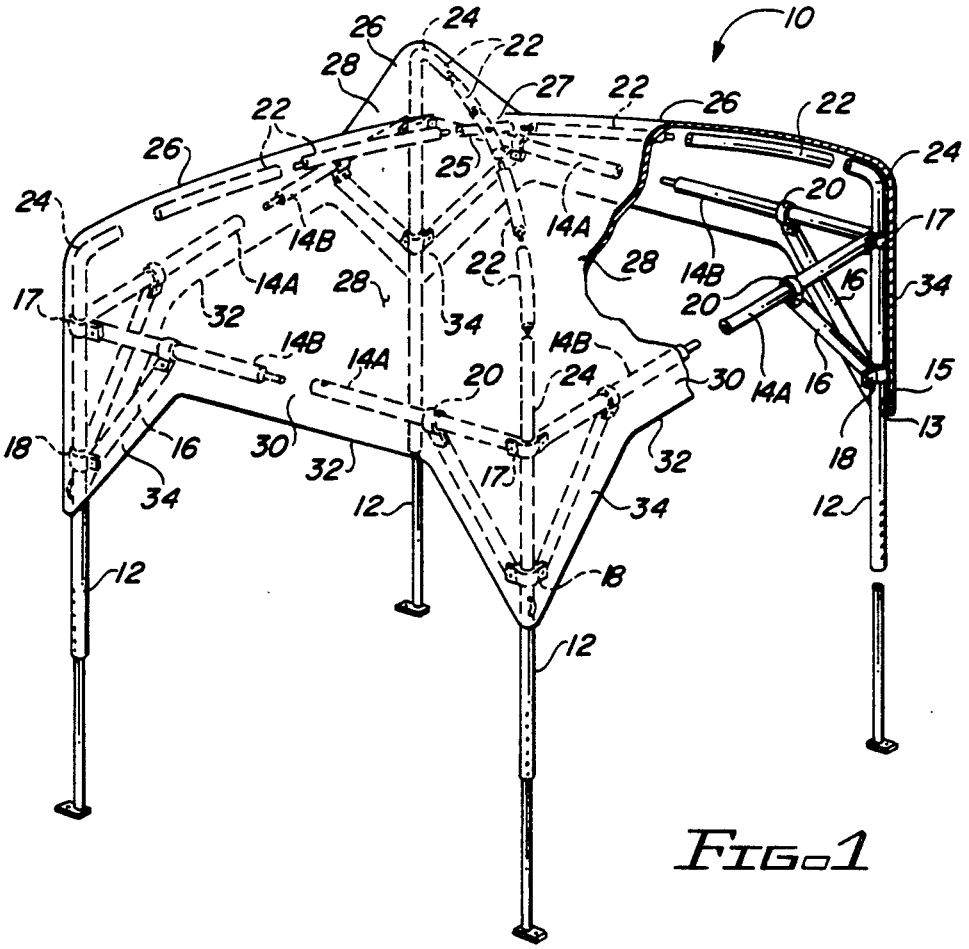
FIG. 1 is a perspective view of the portable protective cover of the present invention, with a portion of the roof cover cut away, and with a portion of the structural framework shown in an exploded manner, and in which that portion of the structural framework located underneath the roof cover is illustrated by dotted lines.
Figure 2:
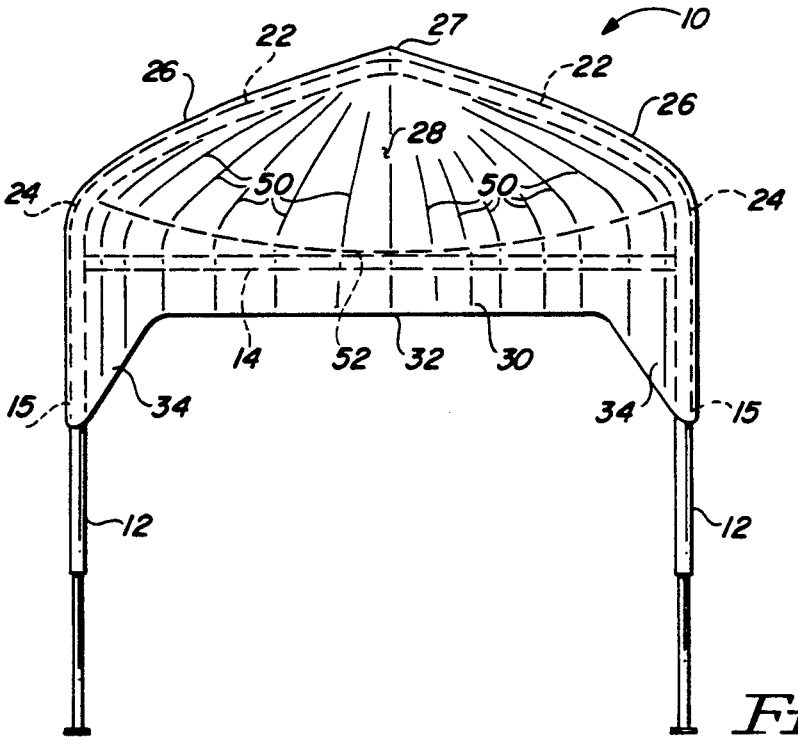
FIG. 2 is a front elevation of the portable protective structure of the present invention, with shade and dotted lines illustrating the form of the concave trough in the intermediate field between adjacent vertical and roof supports.
Figure 3:
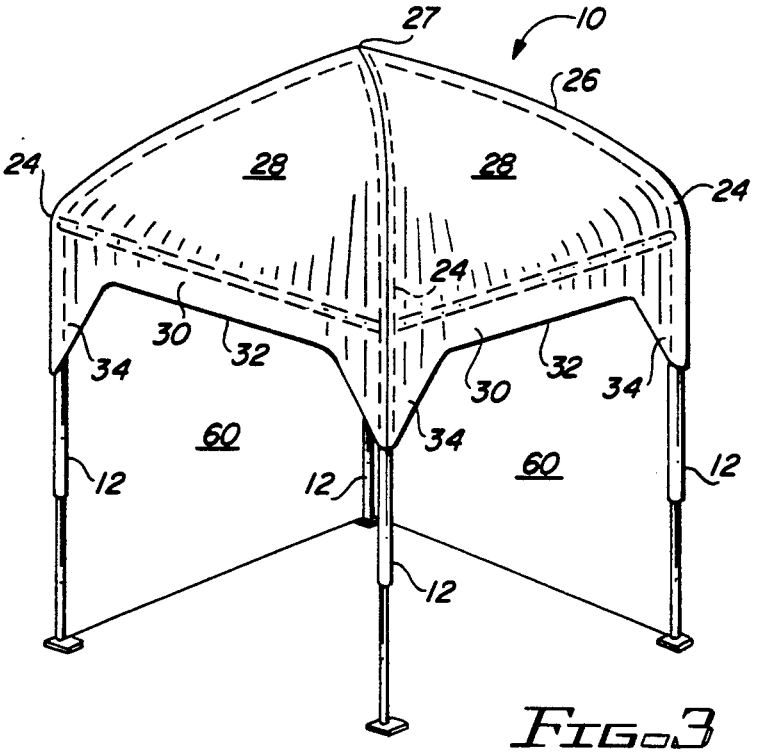
FIG. 3 is a front perspective view similar to that shown in FIG. 1, and which further illustrates the removable side panels useful with the portable protective structure of the present invention.

The portable shade structure is referred to in FIGS. 1-3. generally by the reference numeral 10. The structure 10 includes a portable, knockdown structural framework including plural vertical supports 12, each of which has an intermediate hole 13 therein for receiving a hook 15, which is attached to the elongated extension 34 of the roof cover 26, in a manner more fully described below. The vertical supports 12 further include a pivot plate 17 to which are pivotably coupled two horizontal support segments 14 which, in the example of FIG. 1-3, at right angles with respect to each other. Each horizontal support segment 14 is supported by pivot arm 16, which in turn is coupled to a slideable pivot collar 18 along the vertical support 12 at one end of each respective pivot arm 16, and with the other end of the pivot arm 16 coupled to a ring 20 engaged to the corresponding horizontal support segment 14. Alternatively, the ring 20 may slide and the collar 18 may be fixed.

The upper extremity of each vertical support 12 defines a smooth curve 24, and is adapted to mate with a corresponding outwardly bowed roof support 22. As shown in FIG. 1, the outwardly bowed roof support may be segmented into plural sections and extend upwardly into a peak member 25.

The two horizontal support segments 14 associated with each vertical support 12 are characterized by two slightly different segments 14A and 14B; as shown in FIG. 1, the support segment 14B has a swaged end which is adapted to fit into and be locked with support segment 14A attached to the next adjacent vertical support 12. It will thus be appreciated that the structural framework including vertical supports 12, horizontal support segments 14A and B, roof support sections 22 and roof peak 25 may be easily and quickly assembled when the portable protective structure 10 is to be set up, and likewise be easily and quickly disassembled when the structure 10 is to be taken down.

The structure 10 includes a removable roof cover 26, which may either comprise a flexible shade fabric or a relatively inflexible protective material, such as a vinyl laminate, or a coated nylon, polyester or cotton. In either event, the roof cover 26 is sewn so as to have relatively baggy corners which fit across the upstanding smooth curves 24 of the vertical supports 12, and which define a generally triangular intermediate field 28 between adjacent combinations of the vertical supports 12, horizontal support segments 14A, 14B, roof support sections 22 and roof peak 25 (the peak of the roof cover 26 is designated as element 27 in the drawing. The intermediate field 28 thus defines a generally concentric trough which tends to shed water downwardly from the roof sections 22 and across the horizontal support segments 14A, 14B.

In order to make the roof cover 26 taut across the intermediate fields 28 and facilitate the avoidance of roof sagging and pocketing, the roof cover 26 is provided with a peripheral hem which extends below the level of the horizontal support segments 14A, 14B and an elongated extension 34 of the roof cover 26, each elongated extension 34 extending downwardly along a corresponding vertical support 12, and having the hook 15 attached at the extremity thereof for engagement in the hole 13 (note FIG. 1). It will thus be understood that the elongated extensions 34 and the associated hooks permit the drawing taut of the roof cover 22 across the smooth curve 24, and further facilitate the stretching of the intermediate fields 28 across the horizontal supports 24, thus substantially avoiding any likelihood of roof sag or pocketing.

While downward extensions like that of 34 are known in the prior art as discussed above, such extensions have been primarily for aesthetic purposes, as such arrangements generally extend all the way to the bottom of the corresponding vertical support. However, as shown in FIG. 1, it is preferred that the elongated extensions 34 of the roof cover 26 not extend beyond about one-third of the dimension of the vertical support, in order to achieve the necessary tightening in a lateral direction from the center of the span of the horizontal supports 14A, 14B.

Noting FIG. 2, it will be seen that when the roof cover 26 is stretched taut across the structural framework with the elongated extensions 34 attached in place, the intermediate field 28 defines a generally concave trough, with the smooth curves 24 elevating the corners of the roof cover, and facilitating that trough-like condition. Shade lines 50 and dotted line 52 illustrate the manner in which the trough is defined.

Figure 4:
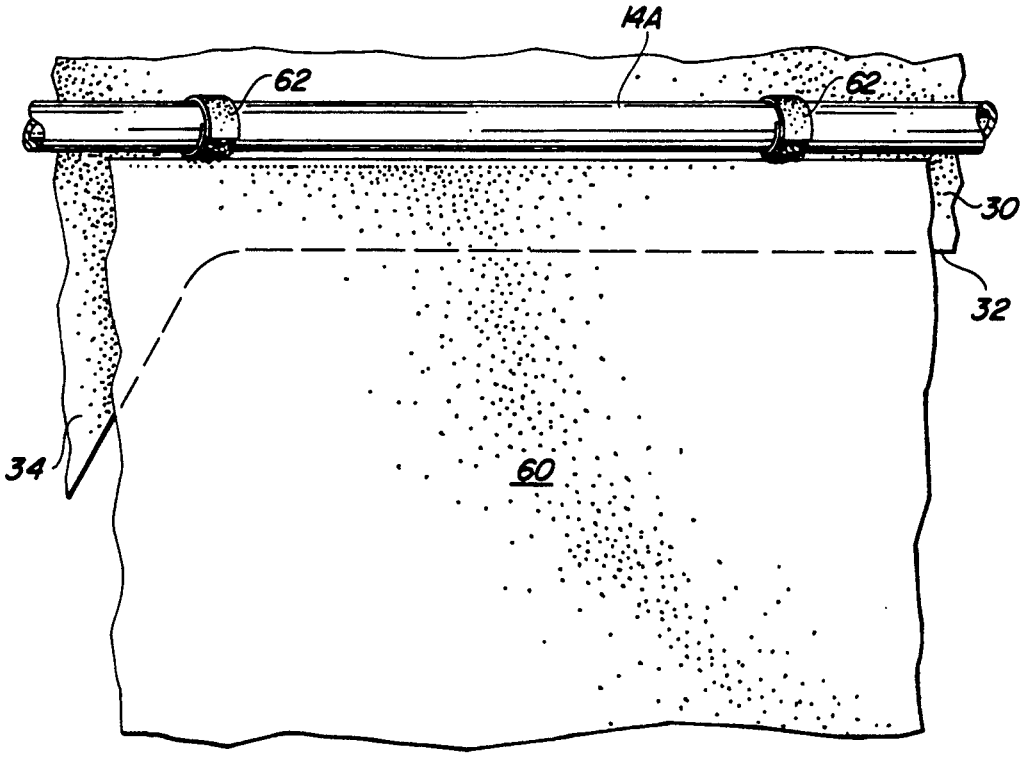
FIG. 4 is a cut away, side view illustrating the manner in which the side panels are removably coupled to the horizontal support segments of the structural framework.

Noting FIG. 3, the particular arrangement of the portable structure 10 is suitable for the attachment of removable protective panels 60 between adjacent vertical supports and which are attached to the horizontal support segments in the manner shown in FIG. 4. For example, removable hook-and-loop fasteners 62 are joined to the panel 60, and permit the easy installation and removal of the vertical panels 60.

It will thus be appreciated by those skilled in the art that the portable protective structure 10 shown in the drawing and described above is adapted for frequent set-up and takedown and therefore may be used in a number of commercial environments, and in a manner which avoids roof sag and pocketing even where the structure is subject to frequent use.

What is claimed is:

1. A portable structure adapted for frequent set-up and take-down and which avoids roof sag and pocketing, the structure comprising:

a portable framework including plural vertical supports and plural horizontal supports, with some of the horizontal supports bridging between, and attached with, adjacent vertical supports;

a removable roof cover dimensioned to extend over, and be removably attached to the structural framework, the roof cover defining plural corners, with each corner positioned at an intersection of a horizontal support and a vertical support, the roof cover further including an intermediate roof field between adjacent corners, the removable roof cover further comprising a peripheral hem extending below the bridging horizontal supports and between the adjacent vertical supports when the removable roof cover is stretched across the structural framework, the peripheral hem defining an elongated extension of the cover extending along each vertical support;

means for securing the extremity of each elongated extension along an adjacent vertical support to facilitate the stretching of the removable roof cover taut across the structural framework; and means for elevating the corners of the roof cover with respect to the intermediate field in order to avoid roof sag and pocketing across each intermediate field.

2. The portable protective structure recited in claim 1 wherein the structural framework further comprises plural roof supports, each roof support extending from a generally central vertical peak outwardly to a corresponding one of the vertical supports.

3. The portable protective structure recited in claim 2 wherein the means for elevating each corner of the roof cover is adjacent to an intersection of a vertical support and a roof support.

4. The portable protective structure recited in claim 3 wherein the peripheral hem extends below the bridging horizontal supports and between adjacent vertical supports when the roof cover is stretched across the structural framework whereby each intermediate field lies taut across the roof and horizontal supports and around the vertical supports, with each intermediate field defining a generally concave trough.

5. The portable protective structure recited in claim 3 wherein each corner comprises a smooth bend in the structural framework adjacent a corresponding intersection of a roof support and a vertical support.

6. The portable protective structure recited in claim 5 wherein each roof support is bowed upwardly between the peak and the intersection with the corresponding vertical support.

7. The portable protective structure recited in claim 5 wherein each bridging horizontal support is defined by plural segments between adjacent vertical supports.

8. The portable protective structure recited in claim 7 wherein each horizontal support segment is pivotably coupled to one of the vertical supports.

9. The portable protective structure recited in claim 8 further comprising a pivot arm coupled to each horizontal support segment and the corresponding vertical support.

10. The portable protective structure recited in claim 9 further comprising a collar engaged with each vertical support, and wherein one end of two of the pivot arms are coupled to the collar at each vertical support.

11. The portable protective structure recited in claim 10 further comprising a ring engaged with each horizontal support segment and wherein the other end of each pivot arm is engaged with a corresponding one of the rings along the adjacent horizontal support segment.

12. A portable protective structure adapted for frequent set-up and take-down and which avoids roof sag and pocketing, the structure comprising:

a structural framework including plural vertical supports, plural horizontal supports and plural roof supports, with each roof support extending from a common central peak outwardly to, and intersecting with a corresponding vertical support, with a curved corner at the upper extremity of each vertical support and with the horizontal supports bridging between adjacent vertical supports, each horizontal support intersecting with the adjacent vertical supports at a point substantially below the curved corners;

a removable roof cover dimensioned to extend over and removably attached to the structural framework, the roof cover defining plural corners, with each roof cover corner overlying a corresponding curved corner along the upper extremity of the corresponding vertical support, the roof cover further comprising a peripheral hem overlapping and extending below the horizontal supports; means for elevating the corners of the roof cover with respect to the intermediate field in order to avoid roof sag and pocketing across each intermediate field; and means for stretching and securing the peripheral hem to the vertical supports so as to draw the roof cover taut across the structural framework.

13. The portable protective structure recited in claim 12 wherein the roof cover and the peripheral hem further define an elongated extension of the cover extending along each vertical support, and wherein the means for stretching and securing the peripheral hem to the vertical supports comprises means for attaching the elongated extension along the vertical support.

14. The portable protective structure recited in claim 12 wherein each bridging horizontal support comprises plural segments between adjacent vertical supports.

15. The portable protective structure recited in claim 14 further comprising a pivot arm coupled to each horizontal support segment and the corresponding vertical support.

16. A portable protective structure adapted for frequent set-up and take-down, comprising:

a portable structural framework including plural vertical supports, plural horizontal support segments and plural roof supports, each vertical support having a pair of the horizontal support segments pivotably coupled thereto at one end of each horizontal support segment adjacent to the upper extremity of the corresponding vertical support, the associated pair of horizontal support segments disposed at a predetermined angle common to all of the vertical supports, each horizontal support segment having an opposing end interfitting with a horizontal support segment associated with the adjacent vertical support, each roof support extending from a central peak to one of the vertical supports;

a removable roof cover dimensioned to extend over and removable attached to the structural framework, the removable roof cover defining a peripheral hem which extends below the horizontal support segments; means for elevating the corners of the roof cover with respect to the intermediate field in order to avoid roof sag and pocketing across each intermediate field; and means for securing the peripheral hem to the vertical supports below the horizontal supports.

17. The portable protective structure recited in claim 16 further comprising a vertical wall panel between two adjacent vertical supports, and means for detachably coupling the vertical wall to the horizontal support segments between adjacent vertical supports.

* * * * *